US005201096A

United States Patent [19]

Dubach et al.

[11] Patent Number: 5,201,096

[45] Date of Patent: Apr. 13, 1993

[54] HINGE

[75] Inventors: Fredi Dubach, Adetswil, Switzerland; Erich Röck, Höchst, Austria

[73] Assignee: Julius Blum Gesellschaft m.b.H., Höchst, Austria

[21] Appl. No.: 927,725

[22] Filed: Aug. 11, 1992

Related U.S. Application Data

[63] Continuation of Ser. No. 719,494, Jun. 24, 1991, abandoned.

[30] Foreign Application Priority Data

Jun. 25, 1990 [AT] Austria ..... A1342/90

[51] Int. Cl.[5] ..... E05D 7/04

[52] U.S. Cl. ..... 16/236; 16/235; 16/343; 16/374; 16/375; 16/389

[58] Field of Search ..... 16/235, 236, 237, 343, 16/374, 375, 389, 392

[56] References Cited

U.S. PATENT DOCUMENTS

| | | | |
|---|---|---|---|
| 4,819,298 | 4/1989 | Lautenschlager | 16/237 |
| 4,914,782 | 4/1990 | Rupprechter | 16/349 |
| 5,029,362 | 7/1991 | Prodan | 16/236 |

FOREIGN PATENT DOCUMENTS

| | | | |
|---|---|---|---|
| 2548153 | 5/1977 | Fed. Rep. of Germany | 16/236 |
| 2730940 | 1/1979 | Fed. Rep. of Germany | 16/236 |
| 3116745 | 11/1982 | Fed. Rep. of Germany . | |
| 3516480 | 11/1986 | Fed. Rep. of Germany | 16/235 |
| 1066710 | 4/1967 | United Kingdom | 16/235 |

*Primary Examiner*—David Jones

*Attorney, Agent, or Firm*—Wenderoth, Lind & Ponack

[57] ABSTRACT

A hinge, in particular a folding door hinge, includes a hinge arm which may be mounted by means of a base plate on a furniture unit part. The hinge arm may be adjusted in two dimensions on the base plate and is connected via at least one joint pin to a hinge pot. An end of the hinge arm facing the joint pin is angled and mounted on such end is a linearly displaceable extension member that carries the joint pin.

31 Claims, 6 Drawing Sheets

β
5
15
18
12
7
8
19'
2
1
16
6
α
17
13
2
19
3
5
4
3
15

A 23
24
9
7
21
8
2
12
18
14
11
20
21
10
22
6
16
17
13
19
3

HINGE this application is a continuation of now abandoned application Ser. No. 07/719,494, filed Jun. 24, 1991.

BACKGROUND OF THE INVENTION

The invention relates to a hinge having a hinge arm which may be mounted by means of a base plate or the like to a first furniture unit part, which may be adjusted in preferably at least two dimensions on the base plate and which is connected via at least one joint pin to a hinge pot or the like which is mounted on a second furniture unit part.

SUMMARY OF THE INVENTION

It is the object of the invention to provide a hinge which advantageously may be used for a folding door which lines an inner corner. Such inner corners are found, for example, in fitted or custom kitchens.

By means of the hinge according to the invention, it advantageously is to be possible both to open only one door leaf of the folding door, so that the leaf projects into the room, or indeed to open both door leaves, which are then advantageously to be positioned such that they bear against the adjacent front side of a kitchen cabinet or the like.

According to the invention, this object is achieved by a hinge for folding doors and comprising a first hinge part fastenable to the rear side of a first folding door leaf and a second hinge part fastenable to the rear side of a second folding door leaf. The second hinge part is articulated to the first hinge part via a joint with at least one joint pin. The first hinge part comprises a hinge arm which is adapted to be adjustably fastened to a base member. The end of the hinge arm which faces the joint pin (or joint pins) is inclined or angled. An extension member is adjustably fastened to such end of the hinge arm. The mounting plane of the first hinge part associated with the rear side of the first door leaf includes in the closed position a reflex angle, preferably of 270°, with the mounting plane of the second hinge part, which is preferably a hinge pot, associated with the rear side of the second door leaf.

In accordance with the current state of the prior art, doors which are either 16 or 22 mm thick are used, or chipboard which is 16 or 22 mm thick for producing kitchen doors is used. In order that the hinge according to the invention can be used with both door thicknesses, the extension member is mounted to be linearly displaceable. The angled end of the hinge arm in this case extends at an angle of approximately 45° to the plane of mounting of the hinge arm. Here, such plane of mounting corresponds to the rear side of the door leaf of the folding door on which the hinge arm is mounted. Advantageously, it is provided for the angled end of the hinge arm to have, in a manner known per se, an elongate hole through which projects a clamping screw which is mounted in the extension member.

In order that the outer door leaf in which the hinge pot is secured does not swing too freely and also to provide a stop which fixes such door leaf at an angle of 90° to the door leaf on which the hinge arm is mounted, a feature of the invention provides for there to be mounted on the extension member a pressing member that, under action of a spring presses against a control cam, known per se, which is provided on the hinge pot. The control cam has, also in a manner known per se, a central stop, which may be overcome, for the pressing member. Advantageously, a helical spring supported on the extension member is mounted in the pressing member.

The invention further relates to a folding door in which door leaves thereof are connected by means of hinges according to the invention, and the folding door is mounted on a furniture frame by means of hinges which have an opening angle of at least 140°, preferably 170°.

BRIEF DESCRIPTION OF THE DRAWINGS

An embodiment of the invention is described below in detail with reference to the attached drawings, wherein.

DETAILED DESCRIPTION OF THE INVENTION

Figure 1:
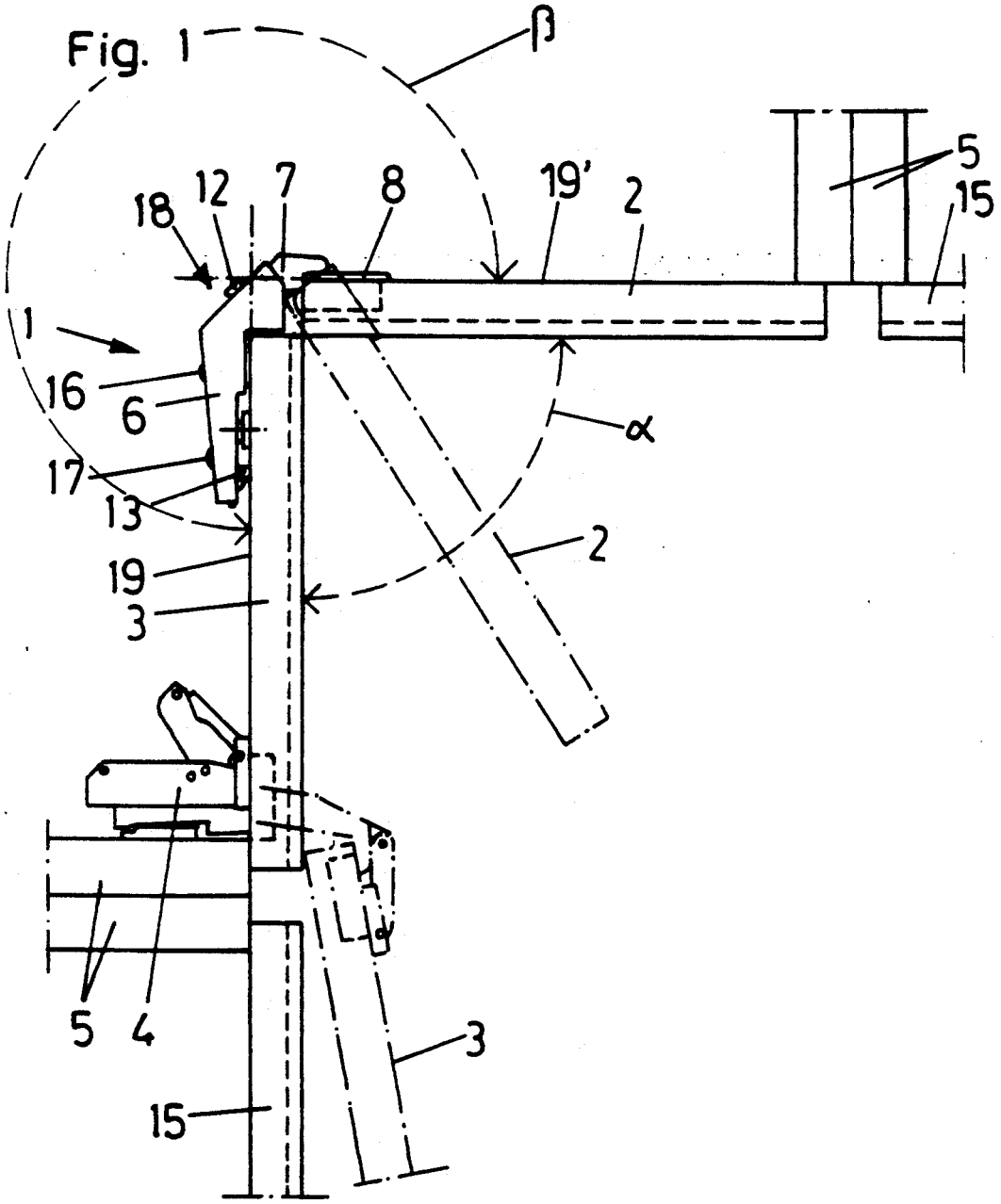
FIG. 1 is a plan view of a folding door having a hinge according to the invention, and of a folding door mounted according to the invention in the inner corner of a fitted cabinet.
Figure 2:
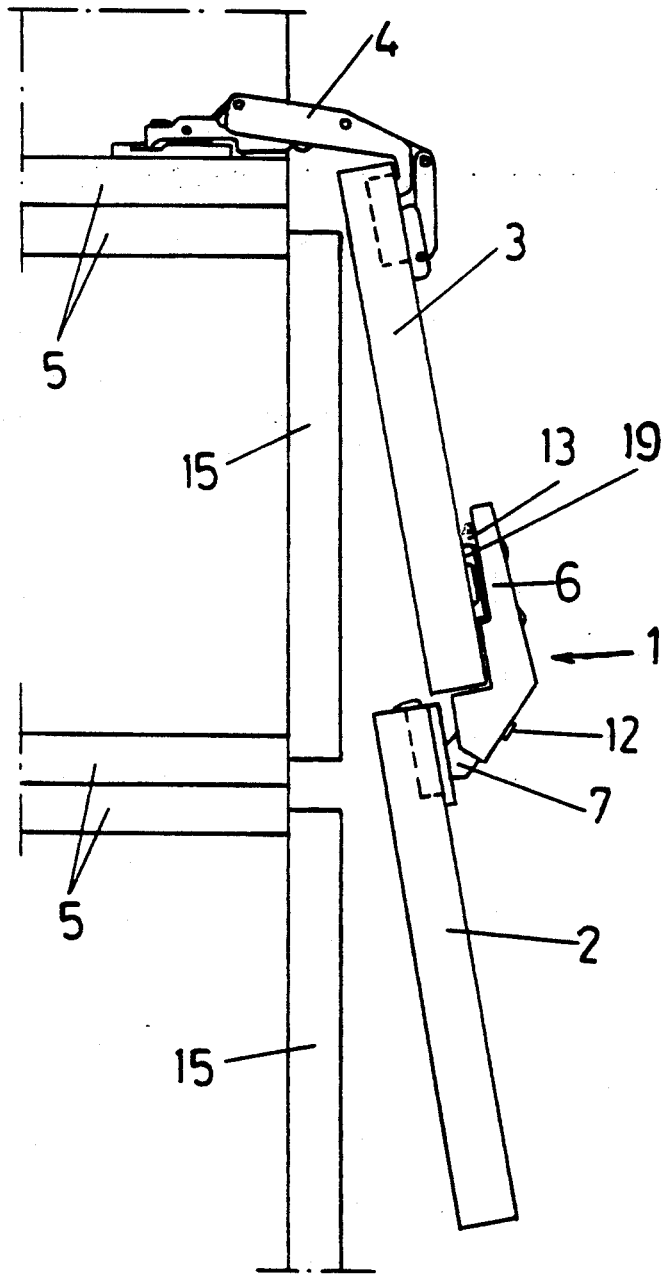
FIG. 2 is a plan view of the folding door shown fully opened.

As can be seen from FIGS. 1 and 2, one or more hinges 1 according to the invention connect two door panels or leaves 2, 3 which are arranged in an inner corner of a fitted cabinet. The door leaf 3 is secured by means of hinges 4 to a side wall 5 of the furniture unit, and the door leaf 2 bears freely against another side wall 5 of the furniture unit that extends at a right angle to that side wall 5 of the furniture unit to which the door leaf 3 is fastened. In the drawings, door panels adjoining the folding door door leaves 2, 3 are designated 15. These door panels 15 are secured in convention manner along edges thereof to side walls 5 of the furniture unit by means of normal hinges. In the closed state, the door leaves 2, 3 and their front sides (visible sides) extend at right angles to one another. The door leaf 3 is mounted by means of hinges 4 on the side wall 5 of the furniture unit, with the hinges 4 having an opening angle of approximately 170°. The hinges 4 may for example be constructed as described in AT-PS 360 852.

The folding door can now be opened either half-way or completely. If it is opened half-way, the door leaf 2 is brought into the position shown in dot-and-dashed lines in FIG. 1. This makes possible access to approximately half the cabinet part covered by the folding door. If the folding door is to be opened completely, then the two door leaves 2, 3 are aligned in one line, as in FIG. 2, and the door leaf 3 is pivoted by means of the hinges 4 by approximately 170°, so that the folding door is positioned in front of the adjacent doors 15 of the fitted cabinet.

The hinge 1 according to the invention includes a hinge arm 6 which is mounted in conventional manner on a base plate 13. The base plate 13 is screwed to the rear side of the door leaf 3 held by the hinge 4 at the side wall 5 of the furniture unit, or is held on door leaf 3 by means of dowels. The hinge arm 6 is secured to the base plate 13 in conventional manner, if necessary by means of an intermediate piece. Advantageously, the hinge arm 6 is secured to the base plate 13 as described in EU-PS 0 200 744. In the drawings, a joint adjustment screw 16 and a clamping screw 17, which also serves for depth adjustment (in a direction parallel to a mounting plane 19, i.e. vertically as shown in FIG. 1), are employed for such mounting.

A front end 18 of the hinge arm 6 extends at an angle of 45° to the plane 19 of mounting of the hinge arm 6. Mounted on this angled end 18 is an extension member 7 which carried the joint pin 10 of the hinge 1. Articulated on the joint pin 10 is a hinge pot 8 which is inserted into an opening in the rear side of the second door leaf 2.

The folding door hinge according to the present invention differs from convention concealed pot hinges essentially in that mounting planes 19, 19' of the two hinge parts, that is of the hinge arm 6 on the one hand, and of the hinge pot 8 on the other hand, in the closed position do not include a right angle (as in the case of hinge 4 in FIG. 1) or an obtuse angle (as in the case of hinges for 40° cross corner cabinet doors), but rather a reflex angle $\beta$ (180°-360°), preferably of 270°, (FIG. 1). The mounting planes 19, 19' lie at the rear sides of the two door leaves 2, 3 of the folding door. The folding door hinge is therefore a "concealed" hinge, i.e. a hinge which is not visible when the folding door is in the closed position.

As mentioned at the outset, in conventional furniture construction door leaves or panels having a thickness of 22 or 16 mm are used. In the drawings, the thickness of the door leaves drawn as solid lines corresponds to a thickness of 22 mm, and the door leaves which are 16 mm thick are drawn as dotted lines. In order that the same hinge 1 can be used with differing door leaf thicknesses, the extension member 7 at the angled end 18 of the hinge arm 6 is rectilinearly displaceable relative to hinge arm 6 in opposite directions in a plane vertical to the axis joint pin 10. In the illustrated embodiment, the angled end 18 has an elongate slot or hole 20, and a clamping screw 12 which projects through the elongate hole 20 is mounted in and engaged with the extension member 7. As a result, the position of extension member 7 can be adjusted relative to hinge arm 6 over the length of the elongate hole 20, so that adjacent end edges of the two door leaves 2, 3 can be positioned always to lie flush against one another when the folding door is closed.

Figure 3:
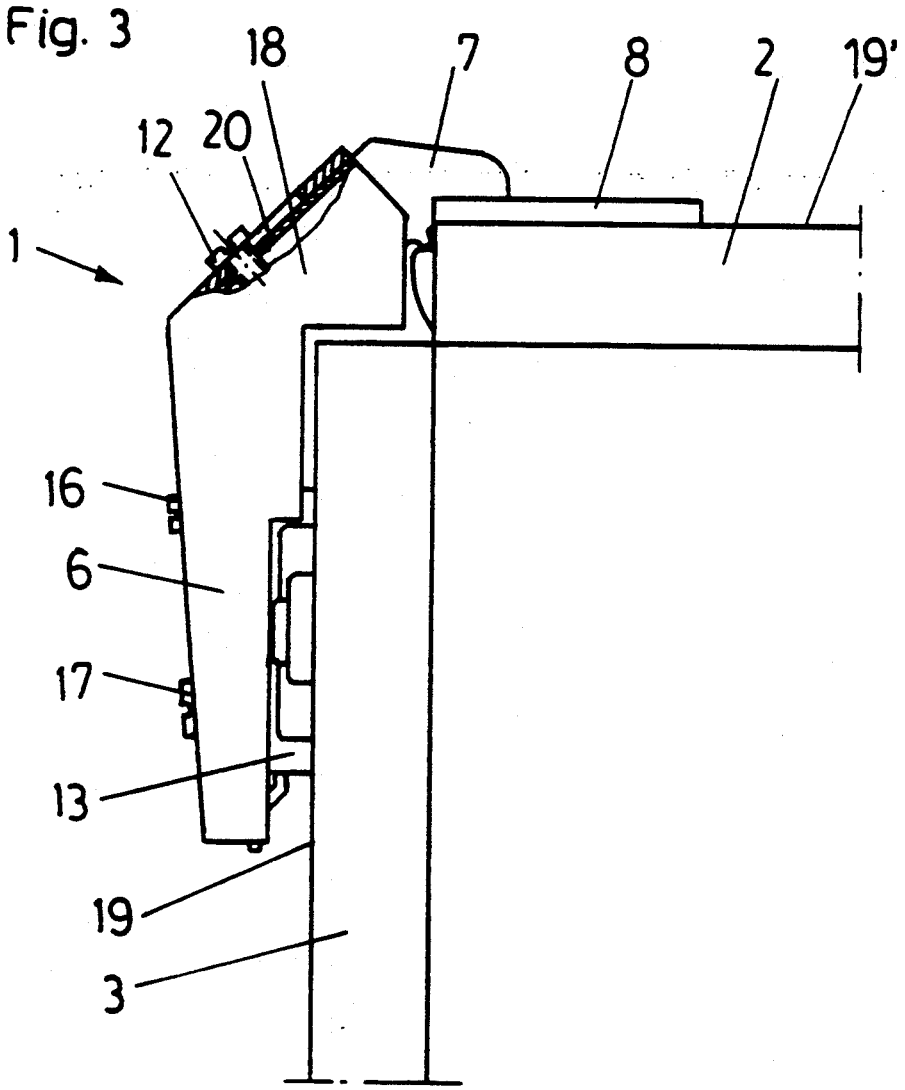
FIG. 3 is a plan view of a hinge according to the invention on an enlarged scale.
Figure 4:
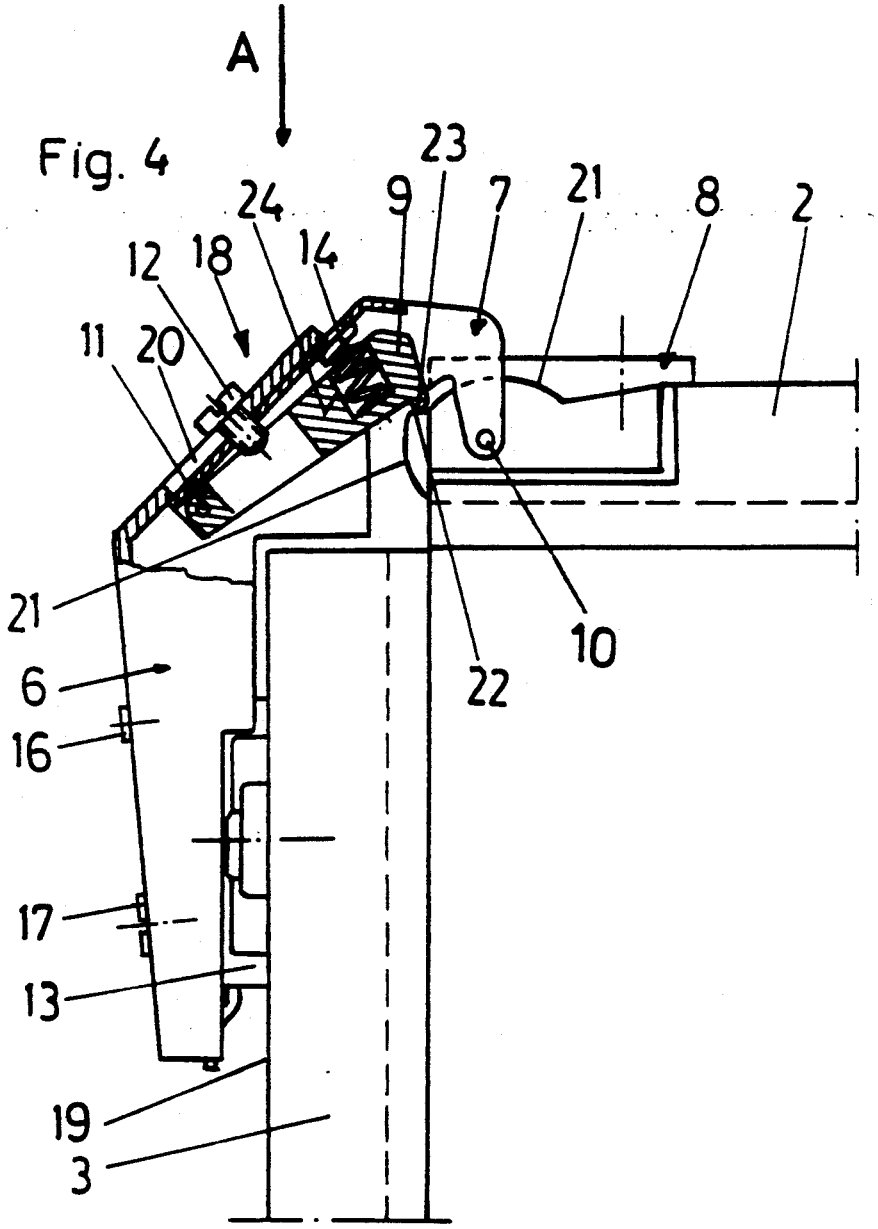
FIG. 4 is a view similar to FIG. 3, but with a hinge arm, an extension member and a pressing member shown in section.
Figure 5:
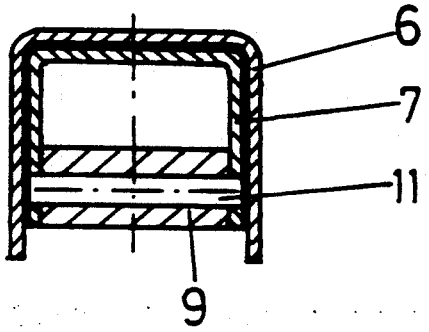
FIGS. 5 to 7 are detailed sections through the hinge arm and the extension member.
Figure 6:
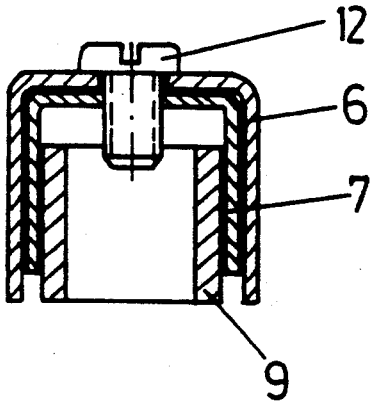
Figure 7:
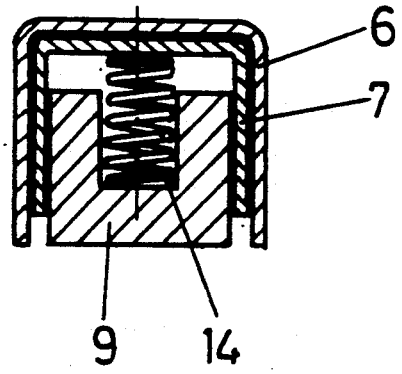
Figure 8:
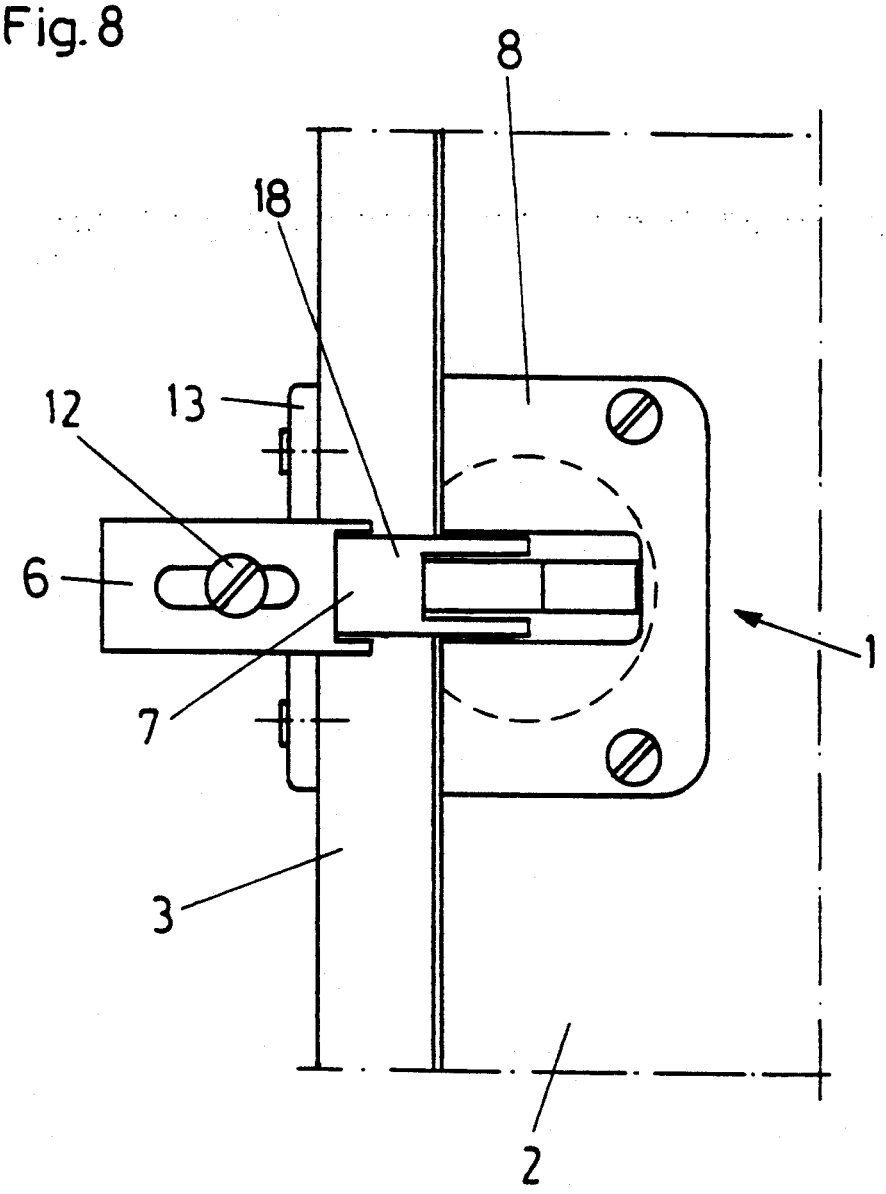
FIG. 8 is a view from the direction of an arrow A in FIG. 4.

Provided on the hinge pot 8 is a control cam 21 which has a stop 22 approximately in the center thereof. A pressing member 9 has a projection or nose 23 that presses against the control cam 21 or that bears against the stop 22. The pressing member 9 is mounted pivotally on the extension member 7 by a pin 11. A front region of the pressing member 9 has therein a cutout or recess 24 which receives a compression spring 14. The compression spring 14 is supported on a central web of the extension member 7 which is constructed to have a U-shaped profile. The compression spring 14, which in the illustrated embodiment is a helical spring, presses the pressing member 9 against the control cam 21. The door leaves 2, 3 remain in the position shown in FIGS. 3 and 4 when the folding door is closed, as a result of the stop 22. If the folding door is to be opened half-way, as shown in dot-and-dashed lines in FIG. 1, then the door leaf 2 can be pivoted to such position if the force of the spring 14 is overcome. The nose 23 of the pressing member 9 in such case moves from the stop 22 and slips over the part of the control cam 21 shown on the left in FIGS. 3 and 4.

If the folding door 22 is to be brought into the position shown in FIG. 2, then first the door wing 3 is pivoted out of the inner corner by means of the hinge 4, whereupon the door leaf 2 is pivoted in the opposite direction, so that the door leaves 2, 3 are aligned approximately in a straight line. Then, both door leaves 2, 3 can be pivoted about the axis of rotation of the hinge 4, i.e. can be opened to such an extent that they are located directly in front of the door leaves 15 of the adjacent doors.

We claim:

1. A furniture hinge comprising:

a base member to be mounted on one furniture part;

a hinge arm mounted on said base member and defining a mounting plane, said hinge arm including an end portion extending in a direction inclined at an acute angle to said mounting plane;

a hinge element to be mounted on another furniture part;

an extension member articulated to said hinge element to enable relative pivotal movement therebetween; and means for mounting said extension member on said inclined end portion of said hinge arm at positions selectively adjustable relative thereto linearly in said direction.

2. A hinge as claimed in claim 1, wherein said extension member is articulated to said hinge element by at least one hinge pin.

3. A hinge as claimed in claim 1, wherein said hinge element comprises a hinge pot to be mounted in a recess in the another furniture part.

4. A hinge as claimed in claim 1, wherein said mounting means comprises a slot extending through said inclined end portion and elongated in said direction, and a clamping screw extending through said slot and engaged with said extension member.

5. A hinge as claimed in claim 1, wherein said direction is inclined at approximately 45° to said mounting plane.

6. A hinge as claimed in claim 1, further comprising a control cam on said hinge element, and a pressing member mounted on said extension member and spring biased toward said control cam.

7. A hinge as claimed in claim 6, wherein said control cam has thereon a central stop against which said pressing member is biased to thereby tend to maintain a pivot position of said hinge element relative to said extension member.

8. A hinge as claimed in claim 7, wherein said pressing member has extending therefrom a projection urged into abutment with said central stop.

9. A hinge as claimed in claim 6, further comprising a compression spring mounted between said extension member and said pressing member and urging said pressing member away from said extension member toward said control cam.

10. A hinge for hingingly connecting first and second door panels to form a folding door such that the door panels are foldable relative to each other between a closed position and opened positions, said hinge comprising:

a base member to be mounted on a rear side of the first door panel;

a hinge arm mounted on said base member and defining a first mounting plane, said hinge arm including an end portion extending in a direction inclined at an acute angle to said first mounting plane;

a hinge element to be mounted on a rear side of the second door panel and defining a second mounting plane;

an extension member mounted on said inclined end portion of said hinge arm and articulated to said hinge element, thereby to enable pivotal movement therebetween and the relative folding of the door panels;

means for enabling adjustment of the mounting position of said extension member on said inclined end portion of said hinge arm linearly in said direction; and said first and second mounting planes including a reflex angle at a relative pivotal position between said extension member and said hinge element corresponding to the closed position of the door panels.

11. A hinge as claimed in claim 10, wherein said extension member is articulated to said hinge element by at least one hinge pin.

12. A hinge as claimed in claim 10, wherein said hinge element comprises a hinge pot to be mounted in a recess in the second door panel.

13. A hinge as claimed in claim 10, wherein said adjustment enabling means comprises a slot extending through said inclined end portion and elongated in said direction, and a clamping screw extending through said slot and engaged with said extension member.

14. A hinge as claimed in claim 10, wherein said direction is inclined at approximately 45° to said first mounting plane.

15. A hinge as claimed in claim 10, further comprising a control can on said hinge element, and a pressing member mounted on said extension member and spring biased toward said control cam.

16. A hinge as claimed in claim 15, wherein said control cam has thereon a central stop against which said pressing member is biased to thereby tend to maintain a pivot position of said hinge element relative to said extension member.

17. A hinge as claimed in claim 16, wherein said pressing member has extending therefrom a projection urged into abutment with said central stop.

18. A hinge as claimed in claim 15, further comprising a compression spring mounted between said extension member and said pressing member and urging said pressing member away from said extension member toward said control cam.

19. A hinge as claimed in claim 10, wherein said reflex angle is approximately 270°.

20. A folding door assembly to be mounted on an article of furniture, said assembly comprising first and second door panels, at least one first hinge for mounting said first door panel on the article of furniture for opening and closing movement relative thereto, and at least one second hinge mounting said second door panel on said first door panel to enable folding movement relative thereto between a closed position and opened positions, said at least one second hinge comprising:

a base member mounted on a rear side of said first door panel;

a hinge arm mounted on said base member and defining a first mounting plane, said hinge arm including an end portion extending in a direction inclined at an acute angle to said first mounting plane;

a hinge element mounted on a rear side of said second door panel and defining a second mounting plane;

an extension member mounted on said inclined end portion of said hinge arm and articulated to said hinge element, thereby to enable pivotal movement therebetween and the relative folding of said door panels;

means for enabling adjustment of the mounting position of said extension member on said inclined end portion of said hinge arm linearly in said direction; and said first and second mounting planes including a reflex angle at a relative pivotal position between said extension member and said hinge element corresponding to said closed position of said door panels.

21. An assembly as claimed in claim 20, wherein said extension member is articulated to said hinge element by at least one hinge pin.

22. An assembly as claimed in claim 20, wherein said hinge element comprises a hinge pot mounted in a recess in said second door panel.

23. An assembly as claimed in claim 20, wherein said mounting means comprises a slot extending through said inclined end portion and elongated in said direction, and a clamping screw extending through said slot and engaged with said extension member.

24. An assembly as claimed in claim 20, wherein said direction is inclined at approximately 45° to said mounting plane.

25. An assembly as claimed in claim 20, further comprising a control cam on said hinge element, and a pressing member mounted on said extension member and spring biased toward said control cam.

26. An assembly as claimed in claim 25, wherein said control cam has thereon a central stop against which said pressing member is biased to thereby tend to maintain a pivot position of said hinge element relative to said extension member.

27. An assembly as claimed in claim 26, wherein said pressing member has extending therefrom a projection urged into abutment with said central stop.

28. An assembly as claimed in claim 25, further comprising a compression spring mounted between said extension member and said pressing member and urging said pressing member away from said extension member toward said control cam.

29. An assembly as claimed in claim 20, wherein said reflex angle is approximately 270°.

30. An assembly as claimed in claim 20, wherein said at least one first hinge has an opening angle of at least 140°.

31. An assembly as claimed in claim 30, wherein said opening angle is at least 170°.

* * * * *